US010079121B2

(12) United States Patent
Zacharias et al.

(10) Patent No.: US 10,079,121 B2
(45) Date of Patent: Sep. 18, 2018

(54) SWITCHING GAS COOLING AND PARTICLE TRAPPING SYSTEM

(71) Applicant: Eaton Electrical IP GmbH & Co. KG, Schoenefeld (DE)

(72) Inventors: Albert Zacharias, Neuwied (DE); Christian Ruempler, Wexford, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/523,694

(22) PCT Filed: Oct. 26, 2015

(86) PCT No.: PCT/EP2015/074696
§ 371 (c)(1),
(2) Date: May 2, 2017

(87) PCT Pub. No.: WO2016/071134
PCT Pub. Date: May 12, 2016

(65) Prior Publication Data

US 2017/0316895 A1 Nov. 2, 2017

(30) Foreign Application Priority Data

Nov. 6, 2014 (DE) ..... 10 2014 116 196

(51) Int. Cl.
*H01H 9/52* (2006.01)
*H01H 33/56* (2006.01)

(52) U.S. Cl.
CPC ..... *H01H 9/52* (2013.01); *H01H 33/56* (2013.01)

(58) Field of Classification Search
CPC ..... H01H 9/34; H01H 9/342; H01H 9/345; H01H 9/346; H01H 9/52; H01H 2009/523;
(Continued)

(56) References Cited

U.S. PATENT DOCUMENTS 2,632,826 A * 3/1953 Titus ..... H01H 9/346 200/260
3,555,224 A * 1/1971 Frind ..... H01H 9/342 218/149

(Continued)

FOREIGN PATENT DOCUMENTS

DE 3541514 A1 5/1987
DE 19803925 A1 8/1999

(Continued)

*Primary Examiner* — Renee S Luebke
*Assistant Examiner* — William Bolton
(74) *Attorney, Agent, or Firm* — Leydig, Voit & Mayer, Ltd.

(57) ABSTRACT

A system for switching gases appearing after a short-circuit switching procedure in electrical service devices, particularly in low-voltage power switches, includes a switching gas cooling assembly and particle capture arrangement. Downstream of the flow path of switching gases issuing from at least one switching chamber outlet window, the switching gas cooling assembly is arranged in a blow-out chamber. In the space behind the at least one switching chamber outlet window and prior to entry of the switching gases into the switching gas cooling assembly, there is arranged a flow element around which the switching gases can flow and which has a cross section which corresponds to or is greater than the cross section of the switching chamber outlet window. The flow elements act as the particle capture arrangement and thus as a protection device for the switching gas cooling arrangement.

16 Claims, 1 Drawing Sheet

(58) Field of Classification Search
CPC ... H01H 2009/526; H01H 33/10; H01H 33/56
USPC ..... 218/157, 156, 155, 149, 139, 134; 361/165
See application file for complete search history.

(56) References Cited

U.S. PATENT DOCUMENTS

| | | | | |
|---|---|---|---|---|
| 3,621,169 | A * | 11/1971 | Heft | H01H 33/58 218/152 |
| 5,889,249 | A | 3/1999 | Rival et al. | |
| 7,541,902 | B2 * | 6/2009 | Domejean | H01H 9/346 335/201 |
| 2014/0166623 | A1 * | 6/2014 | Page, II | H01H 33/53 218/157 |
| 2015/0279586 | A1 | 10/2015 | Zacharias et al. | |
| 2016/0035517 | A1 | 2/2016 | Zacharias et al. | |

FOREIGN PATENT DOCUMENTS

| | | | |
|---|---|---|---|
| DE | 102012110409 | A1 | 4/2014 |
| EP | 0817223 | A1 | 1/1998 |
| WO | WO 2014135641 | A2 | 9/2014 |

* cited by examiner

SWITCHING GAS COOLING AND PARTICLE TRAPPING SYSTEM

CROSS-REFERENCE TO RELATED APPLICATIONS

This application is a U.S. national stage application under 35 U.S.C. § 371 of International Application No. PCT/EP2015/074696, filed on Oct. 26, 2015, and claims benefit to German Patent Application No. DE 10 2014 116 196.3, filed on Nov. 6, 2014. The International Application was published in German on May 12, 2016, as WO 2016/071134 A1 under PCT Article 21(2).

FIELD

The invention relates to a system comprising a switching gas cooling assembly and a particle trapping assembly for switching gases produced after a short-circuit switching operation in electrical installation equipment, in particular in low-voltage circuit breakers.

BACKGROUND

When switching off electrical currents in installation equipment, such as circuit breakers, a switching arc is formed when the contacts are opened. The arc heats up the air in the switching chamber, leading to a pressure increase and thus to the heated gases flowing out through exhaust openings—referred to as exhaustion in the following. These heated and conductive gases also contain highly dispersed solid particles and molten metal particles, and the conductivity of said gases also changes, depending on the composition and gas temperature, once they have left the installation equipment. When designing switching chambers (housing strength), the processes of exhaustion (temperature, chamber pressure) have to be taken into account.

With regard to the overall cross section of the through-openings, the dimensions of a switching gas cooling assembly are substantially determined by and dependent on the switching capacity or nominal current of the installation equipment. The dimensions are generally optimized such that a high cooling capacity is produced. This generally requires relatively narrow through-openings in the switching gas cooling assembly.

With regard to the prior art of switching gas cooling assemblies having narrow through-openings, the following apparatuses should therefore be mentioned by way of example:

A cooling apparatus in low-voltage circuit breakers is known, in which a close-meshed metal net or grating is used (EP 0817223 B1). Another embodiment is formed as a plate stack (DE 102012110409 A1).

Forming the through-openings as narrow through-openings is disadvantageous in that, after some time, the through-openings become clogged by particles carried along in the exhaust gases, damaging the switching gas cooling assembly. The flow cross section in the switching gas cooling assembly is reduced. The cooling action declines, which in turn affects the pressure and switching conditions in the switching chamber.

SUMMARY

An aspect of the invention provides a system, comprising: a planar flow element; a switching gas cooling assembly; and a particle trapping assembly for one or more switching gases produced after a short-circuit switching operation in electrical installation equipment, wherein the switching gas cooling assembly is arranged in an exhaust chamber, downstream of a flow path of the switching gases leaving at least one switching chamber outlet opening, wherein the planar flow element, configured as a particle trapping assembly, is arranged in a space behind the at least one switching chamber outlet opening and in front of where the switching gases enter the switching gas cooling assembly, wherein the switching gases can flow around the planar flow element, wherein the planar flow element has a cross section that is equal to or larger than a cross section of the switching chamber outlet opening, wherein the switching gas cooling assembly is formed of parallel cooling plates, and wherein the planar flow element is arranged such that a front edge of the planar flow element, facing the switching chamber outlet opening, is at a spacing from the switching gas cooling assembly that is greater than the cross section of the planar flow element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
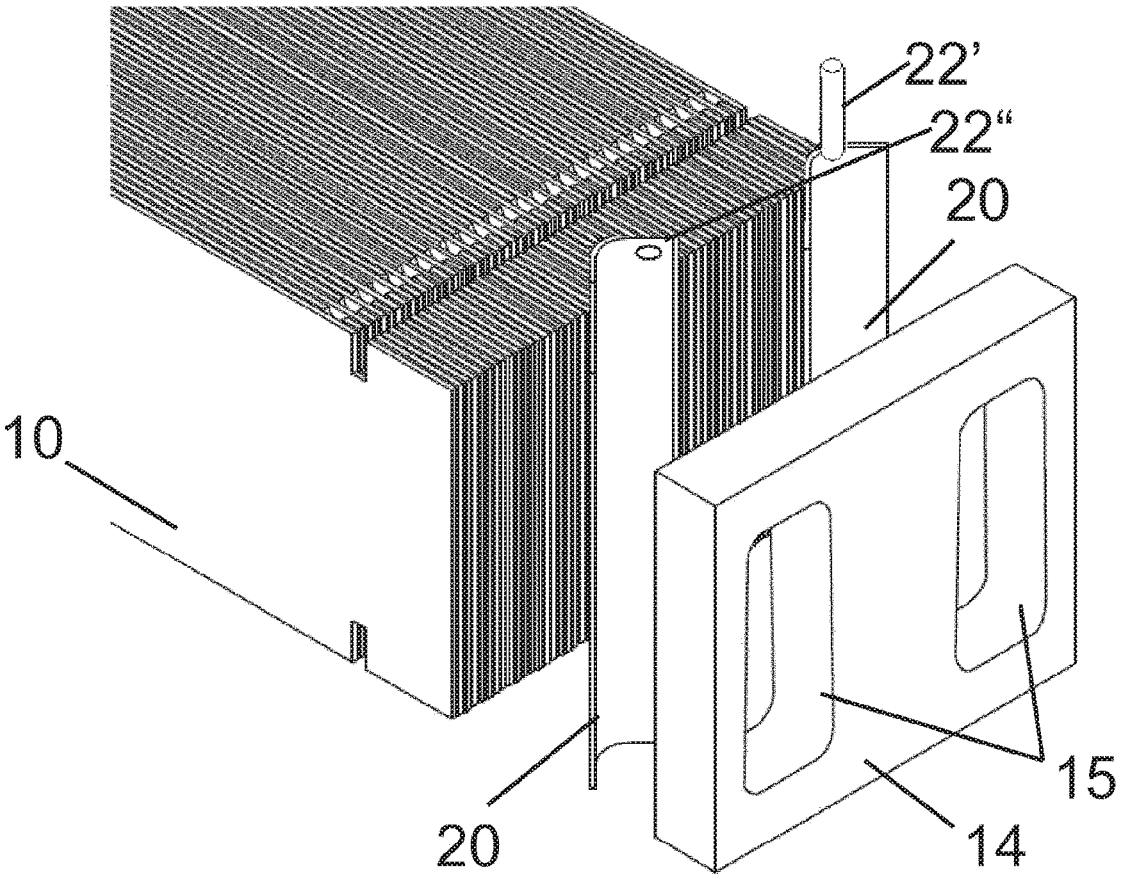
FIG. 1 a detailed perspective view of the assembly.

An aspect of the invention provides an assembly that provides protection against the switching gas cooling assembly becoming blocked.

An aspect of the invention thus provides a system comprising a switching gas cooling assembly and a particle trapping assembly for switching gases produced after a short-circuit switching operation in electrical installation equipment, in particular in low-voltage circuit breakers, a switching gas cooling assembly being arranged in an exhaust chamber, downstream of the flow path of the switching gases leaving at least one switching chamber outlet opening, and at least one planar flow element formed as a particle trapping assembly being arranged in the space behind the at least one switching chamber outlet opening and in front of where the switching gases enter the switching gas cooling assembly, around which flow element the switching gases can flow and which element has a cross section that is equal to or larger than the cross section of the switching chamber outlet opening.

Additional preferred embodiments of the invention are set out in the following:

The flow element formed as a particle trapping assembly is also intended to be referred to as a "baffle plate" in the following. It acts as a device for protecting the switching gas cooling assembly.

Metal particles have a greater inertia than gases. If a suitable flow element is placed in the exhaust stream, the particles fly straight ahead towards the obstruction formed by the flow element. However, the gases are deflected and flow around the obstruction in the direction of the switching gas cooling assembly. The deposits adhere to the obstruction and solidify there. By optimizing the design and position of the baffle plate, the particles do not spray to the side.

The obstruction can consist of a flat material oriented perpendicularly to the flow direction. The surface of the obstruction is intended to be equal to or greater than the cross section of the exhaust opening.

Additional preferred shapes of the obstruction can be baffle plates having a concave curvature. Such concave shapes can include shell-like forms. Depending on the geometric design of the switching mechanism and the switching chamber and/or the power-related fittings of the installation equipment, a concave baffle plate should be oriented such that the concave bulge is provided as a shell that is open in the direction opposite to the switching gas flow direction or an open cavity;

The flow element should be fastened in front of the cooling assembly at a spacing therefrom that is greater than the width of the flow element. In an optimum configuration, on the switching-chamber side, the flow element should be at such a distance that the arc generated in the switching chamber does not jump to the flow element.

The flow element comprises fastening means for fastening in the exhaust chamber.

The flow element should be metal or made of ceramic. The use of metal baffle plates is advantageous since the particles cool quicker and remain adhered to the obstruction.

A flow element should be arranged downstream of the flow path, behind each switching chamber outlet opening.

The switching gas cooling assembly is used to cool hot gases produced during and after a switching operation of the electrical installation equipment. The cooling assembly is located in the flow path of the hot switching gases and comprises narrow through-openings. The material of the cooling assembly has high thermal conductivity and a high thermal capacity. The through-openings are straight or planar and are arranged in parallel with the flow direction of the switching gases such that the switching gases are not deflected.

The material and dimensions of the switching gas cooling assembly are preferably designed for short-circuit switching of the installation equipment.

The switching gas cooling assembly is a plate assembly consisting of sheet metal shapes that form a cuboid. The sheet metal installation equipments form a self-supporting structure of cooling plates that are unreleasably connected to one another. The cooling plates of the cooling assembly can be arranged in parallel with the position of the flow elements.

The overall cross section of the through-openings is substantially determined by and dependent on the switching capacity or nominal current of the installation equipment. The dimensions of the system assembly comprising a cooling assembly and baffle plates relate primarily to the switching capacity during short-circuiting, since, when switching short circuits, the switching mechanism is placed under a maximum amount of strain, and in such cases the switching gases leaving the assembly can carry solid or liquid particles along with them.

FIG. 1 is a perspective view of the assembly, in which the switching gas cooling assembly 10, the switching chamber cover 14 comprising two exhaust openings (switching chamber outlet opening 15) and two flow elements (baffle plates 20) are shown. The switching gas cooling assembly 10 is located in an exhaust chamber and occupies the entire exhaust chamber. The baffle plates 20 form an open cavity that faces in the opposite direction to the switching gas flow direction 30. The switching gas flow can sweep past the baffle plates, particles carried along out of the exhaust openings impinging on the baffle plates and being retained there.

In order to fasten the baffle plates in the exhaust chamber, which also receives the cooling assembly, corresponding recesses 22" are provided in the baffle plates. In addition, the baffle plates can be held in position by small metal pins 22'.

The switching chamber, comprising a contact mechanism and possibly a quenching device for arcs, etc., is located in front of the exhaust opening, and therefore hot switching gases mainly leave via the exhaust opening.

The through-openings 12 in the switching gas cooling assembly can be formed as flat, planar slots, so that they act against the switching gases only with a flow resistance that is necessary for sufficiently cooling the gases.

The cooling metal sheets can in principle be parallel or perpendicular to the arrangement of the baffle plates, depending on the manufacturing standpoint.

The following typical statements are made regarding the dimensions and measurements.

The block (10) formed of the cooling plates 11 is cuboid, i.e. also has planar lateral surfaces. The planar end face can be rectangular, having surfaces of between 400 and 1000 $mm^2$, for example. However, the dimensions of the cooling plates can also vary due to the material selection, it being possible for the thickness measurement to have smaller or greater values, depending on the heat absorption capacity of the cooling plates.

However, these dimensions are not restricted to cuboidal measurements of the end-face. As already mentioned, the measurements are determined by the required cooling effect that should be adapted to the short circuit switching capacity. All the cooling plates preferably have the same thickness. The thickness of the cooling plates can be between 400 and 1000 μm. The plate stack can consist of up to 60 identical cooling plates.

The through-openings 12 preferably have the same width and depth. The width of each of the slots transverse to the flow direction can be graduated according to the gas mass flow to be expected: between 100 and 500 μm. The length of the cooling plates in the flow direction can be from 40 to 100 mm.

Figure 2:
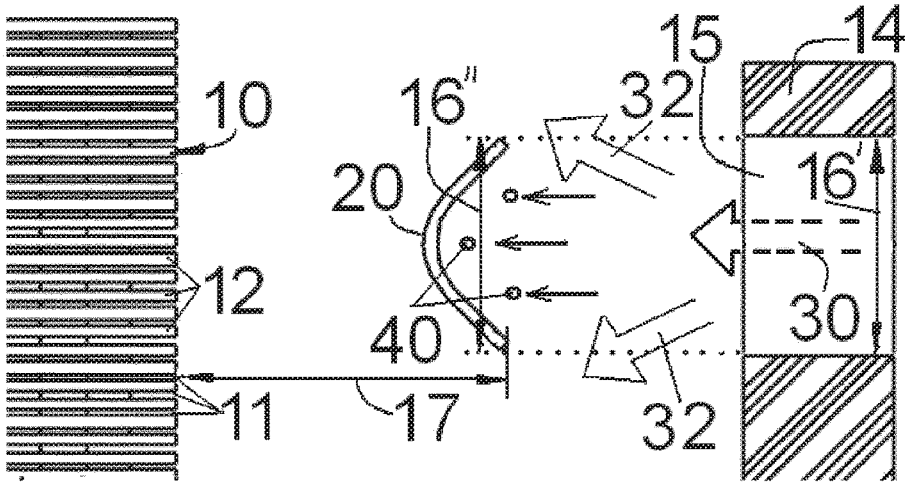
FIG. 2 a detailed view of an aspect of the invention (in section).

FIG. 2 is a sectional plan view of the assembly, in which only one switching chamber outlet opening 15 and one baffle plate 20 is shown. The cooling plates on the end face of the cooling assembly 10 are denoted by reference numeral 12 and the through-openings (slots) in the end face of the cooling assembly are denoted by reference numeral 11.

FIG. 2 shows rectangular baffle plates. These are plates that are continuously angled in the longitudinal direction of the rectangle, therefore forming a C-shaped or V-shaped cross section. The size of the angle can preferably be 90° or less. The switching gas flow sweeps past the baffle plate(s) (32), the particles 40 carried along directly impinging on the baffle plates and being retained there. The width 16" and the height of the baffle plates are adapted to the width and height of the switching chamber outlet opening 15. The cross section of the baffle plates should be congruent with or greater than at least the cross section of the switching chamber outlet opening.

The baffle plates are located between the switching chamber cover 14 and the cooling assembly 10, the spacing 17 (between the front edge of the baffle plate and the inlet surface of the cooling assembly) preferably being greater than the width 16" of the baffle plate. As a result, the flow behind the baffle plates is as homogeneous as possible and the cooling assembly can be used effectively.

It has already been mentioned that the dimensions of the baffle plates are adapted to the cross section of the switching chamber outlet opening. The baffle plates can be extended on one or both sides, so that they can be fastened in the exhaust chamber by means of these extensions.

The space in which the baffle plates are located preferably has to be larger than the surface area of the outlet opening on the switch cover. The gas flow can therefore sweep around the baffle plates.

In summary, the invention relates to a system comprising a switching gas cooling assembly and a particle trapping assembly for switching gases 30 produced after a short-circuit switching operation in electrical installation equipment, in particular in low-voltage circuit breakers. The system is formed by a switching gas cooling assembly and a particle trapping assembly. A switching gas cooling assembly 10 is arranged in an exhaust chamber, downstream of the flow path of the switching gases 30 leaving at least one switching chamber outlet opening 15. A flow element 20 is arranged in the space behind the at least one switching chamber outlet opening 15 and in front of where the switching gases 30 enter the switching gas cooling assembly 10, around which flow element the switching gases can flow and which element has a cross section 16" that is equal to or larger than the cross section 16' of the switching chamber outlet opening 15. The flow elements 20 act as a particle trapping assembly and therefore as a device for protecting the switching gas cooling assembly.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

10 switching gas cooling assembly in an exhaust chamber
11 cooling plates
12 through-openings (slots) in 10
14 switching chamber cover
15 switching chamber outlet opening (exhaust cross section)
16' cross section of the outlet opening
16" surface or cross section of the flow element
17 spacing between the baffle plate front edge and the cooling assembly
20 flow element (baffle plate)
22', 22" baffle plate fastening means (pin, hole)
30 switching gas flow out of the switching chamber (flow path)
32 gas flow sweeping past
40 particle (droplet, solid)

The invention claimed is:

1. A system, comprising:
a planar flow element;
a switching gas cooling assembly; and
a particle trapping assembly for one or more switching gases produced after a short-circuit switching operation in electrical installation equipment,
wherein the switching gas cooling assembly is arranged in an exhaust chamber, downstream of a flow path of the switching gases leaving at least one switching chamber outlet opening,
wherein the planar flow element, configured as the particle trapping assembly, is arranged in a space behind the at least one switching chamber outlet opening and in front of where the switching gases enter the switching gas cooling assembly,
wherein the switching gases can flow around the planar flow element,
wherein the planar flow element has a cross section that is equal to or larger than a cross section of the switching chamber outlet opening,
wherein the switching gas cooling assembly is formed of parallel cooling plates,
wherein the planar flow element is arranged such that a front edge of the planar flow element, facing the switching chamber outlet opening, is at a spacing from the switching gas cooling assembly that is greater than the cross section of the planar flow element, and
wherein the planar flow element has a concave shape and is fastened in the exhaust chamber in a form of a cavity that is open in a direction opposite to a switching gas flow direction.

2. The system of claim 1, wherein the planar flow element includes a fastener configured to fasten in the exhaust chamber.

3. The system of claim 1, wherein the planar flow element includes a metal.

4. The system of claim 1, wherein the planar flow element is arranged downstream of a switching gas flow direction, behind each switching chamber outlet opening.

5. The system of claim 1, wherein the parallel cooling plates include a material having high thermal conductivity and high thermal capacity,
wherein one or more through-openings between the cooling plates are planar and parallel to a switching gas flow direction.

6. The system of claim 5, wherein the material and dimensions of the switching gas cooling assembly are configured for short-circuit switching of the electrical installation equipment.

7. The system of claim 1, wherein the parallel cooling plates are arranged in parallel with a position of the planar flow elements.

8. A low-voltage circuit breaker, comprising the system of claim 1.

9. A system, comprising:

a planar flow element;

a switching gas cooling assembly; and a particle trapping assembly for one or more switching gases produced after a short-circuit switching operation in electrical installation equipment, wherein the switching gas cooling assembly is arranged in an exhaust chamber, downstream of a flow path of the switching gases leaving at least one switching chamber outlet opening, wherein the planar flow element, configured as the particle trapping assembly, is arranged in a space behind the at least one switching chamber outlet opening and in front of where the switching gases enter the switching gas cooling assembly, wherein the switching gases can flow around the planar flow element, wherein the planar flow element has a cross section that is equal to or larger than a cross section of the switching chamber outlet opening, wherein the switching gas cooling assembly is formed of parallel cooling plates, wherein the planar flow element is arranged such that a front edge of the planar flow element, facing the switching chamber outlet opening, is at a spacing from the switching gas cooling assembly that is greater than the cross section of the planar flow element, and wherein the planar flow element includes a ceramic.

10. The system of claim 9, wherein the planar flow element has a concave shape and is fastened in the exhaust chamber in a form of a cavity that is open in a direction opposite to a switching gas flow direction.

11. The system of claim 9, wherein the planar flow element includes a fastener configured to fasten in the exhaust chamber.

12. The system of claim 9, wherein the planar flow element is arranged downstream of a switching gas flow direction, behind each switching chamber outlet opening.

13. The system of claim 9, wherein the parallel cooling plates include a material having high thermal conductivity and high thermal capacity, wherein one or more through-openings between the cooling plates are planar and parallel to a switching gas flow direction.

14. The system of claim 13, wherein the material and dimensions of the switching gas cooling assembly are configured for short-circuit switching of the electrical installation equipment.

15. The system of claim 9, wherein the parallel cooling plates are arranged in parallel with a position of the planar flow elements.

16. A low-voltage circuit breaker, comprising the system of claim 9.

* * * * *